US005697421A

United States Patent [19]

Lin et al.

[11] Patent Number: 5,697,421

[45] Date of Patent: Dec. 16, 1997

[54] INFRARED PRESSURELESS INFILTRATION OF COMPOSITES

[75] Inventors: Ray Y. Lin; Sunil G. Warrier, both of Cincinnati, Ohio

[73] Assignee: University of Cincinnati, Cincinnati, Ohio

[21] Appl. No.: 504,205

[22] Filed: Jul. 6, 1995

Related U.S. Application Data

[63] Continuation of Ser. No. 125,570, Sep. 23, 1993, abandoned.

[51] Int. Cl.[6] ..... B22D 19/14

[52] U.S. Cl. ..... 164/105; 164/97

[58] Field of Search ..... 164/91, 97, 98, 164/103, 105

[56] References Cited

U.S. PATENT DOCUMENTS

| | | | |
|---|---|---|---|
| 3,553,820 | 1/1971 | Sara . | |
| 3,871,834 | 3/1975 | Kuniya | 428/614 |
| 4,450,207 | 5/1984 | Donomoto et al. . | |
| 4,614,690 | 9/1986 | Yamamura | 428/614 |
| 4,732,779 | 3/1988 | Towota et al. . | |
| 4,929,513 | 5/1990 | Kyono | 164/97 |
| 4,978,585 | 12/1990 | Ritter | 164/46 |
| 5,017,438 | 5/1991 | Siemers et al. | 428/614 |
| 5,045,407 | 9/1991 | Ritter . | |
| 5,283,026 | 2/1994 | Okumura | 264/234 |

FOREIGN PATENT DOCUMENTS

| | | | |
|---|---|---|---|
| 57-25275 | 2/1982 | Japan | 164/103 |
| 1-289561 | 11/1989 | Japan | 164/97 |

*Primary Examiner*—Kuang Y. Lin
*Attorney, Agent, or Firm*—Frost & Jacobs

[57] ABSTRACT

The present invention provides a method for infrared pressureless infiltration of composites, including infiltration of carbon fibers and silicon carbide fibers with aluminum and titanium matrices. Composites produced by the methods of the present invention are also included within the scope of this invention.

13 Claims, 9 Drawing Sheets

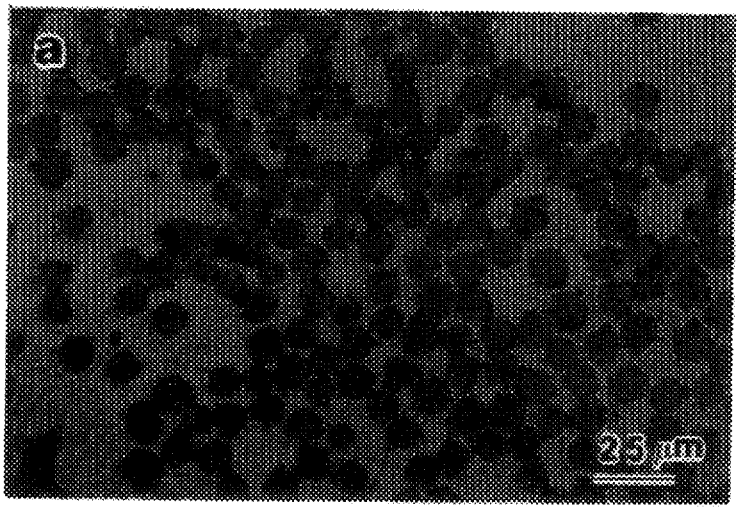
Figure 1 A
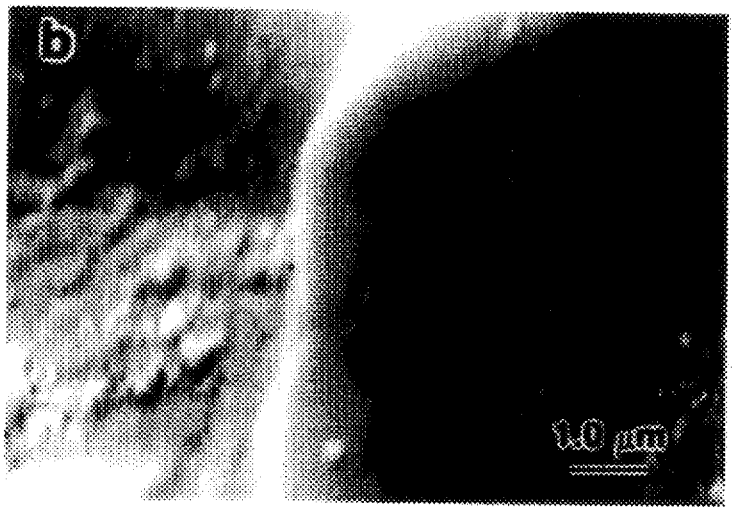
Figure 1 B
Figure 1

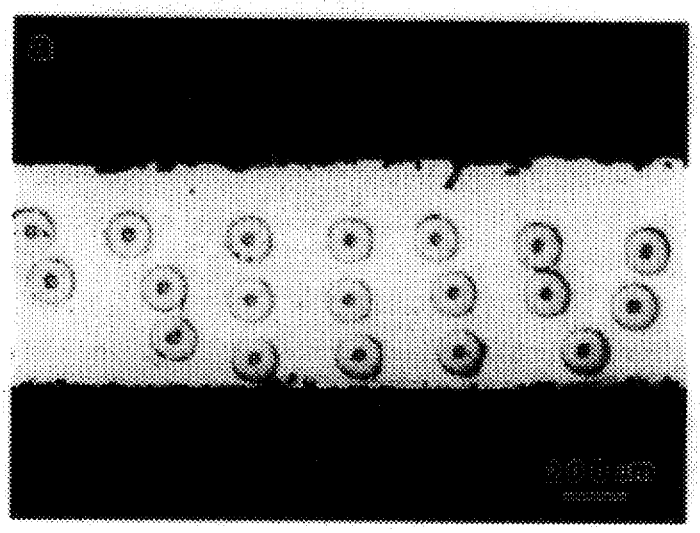
Figure 2 A
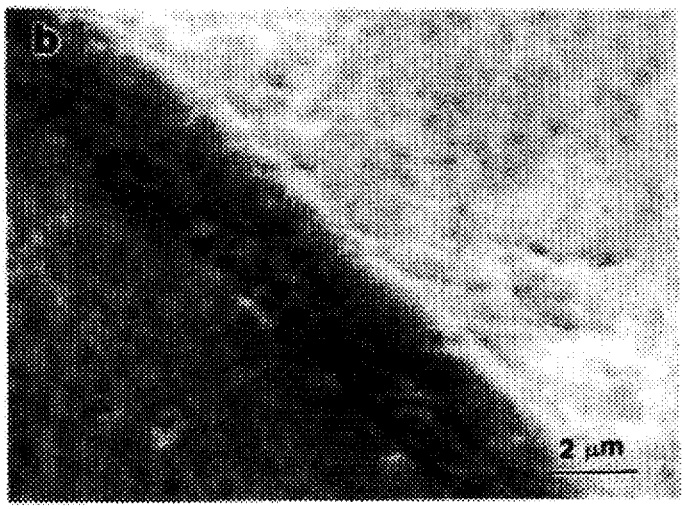
Figure 2 B
Figure 2

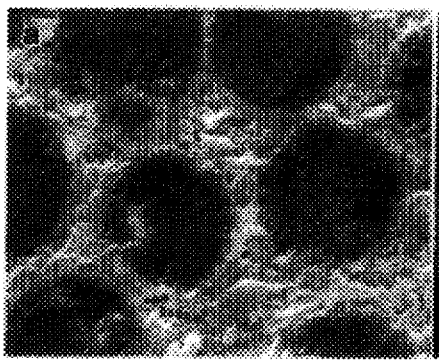
Figure 3 A
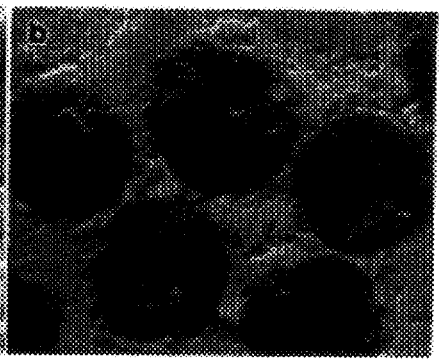
Figure 3 B
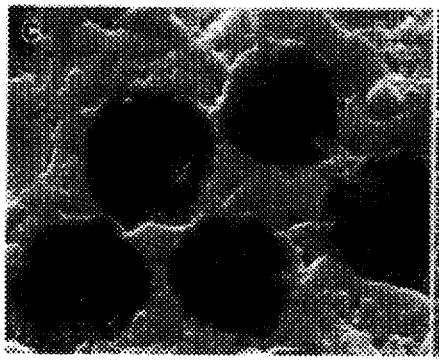
Figure 3 C
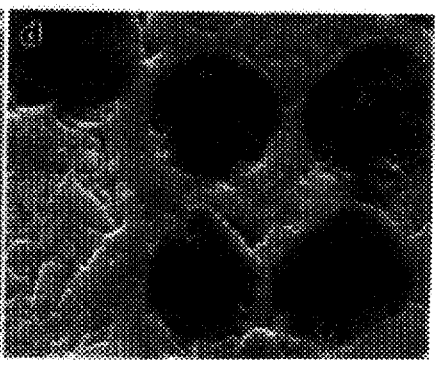
Figure 3 D
Figure 3

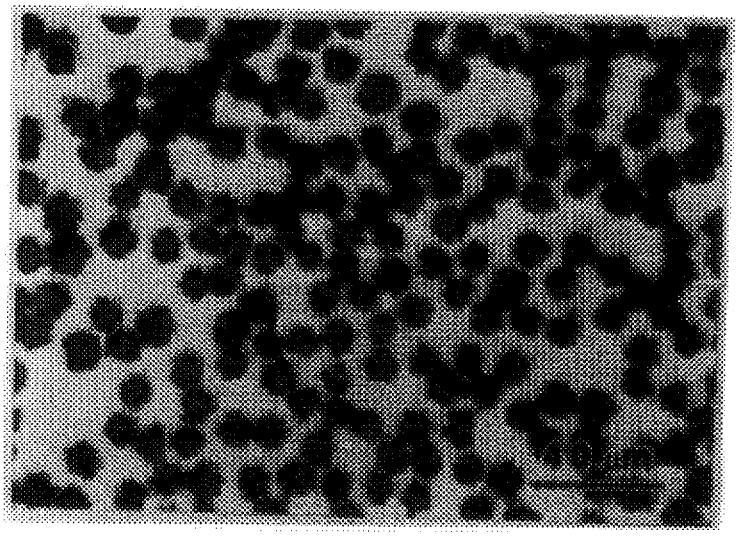
Figure 4 A
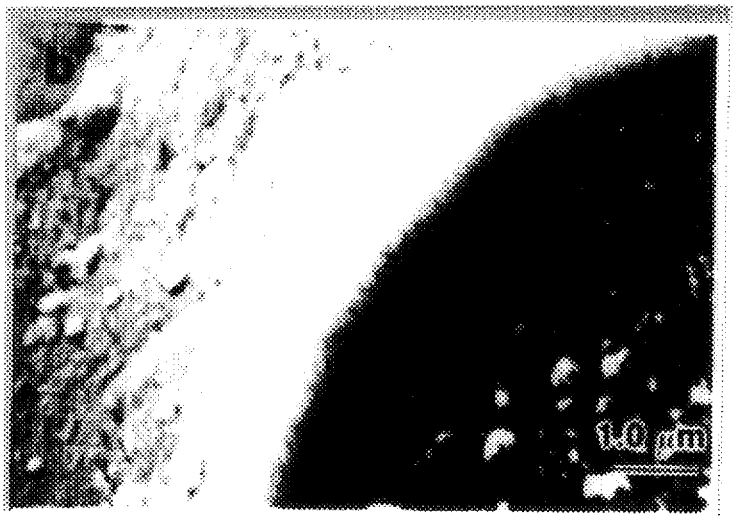
Figure 4 B
Figure 4 a
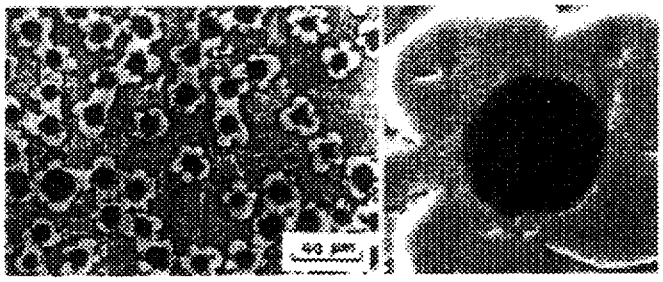
Figure 5 A
b
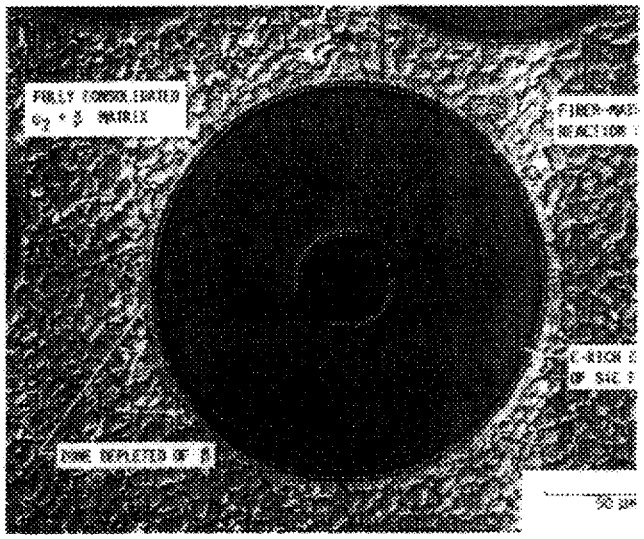
Figure 5 B
Figure 5

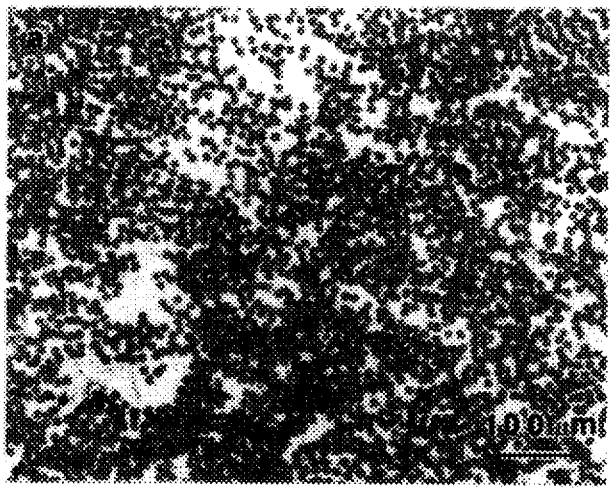
Figure 6 A
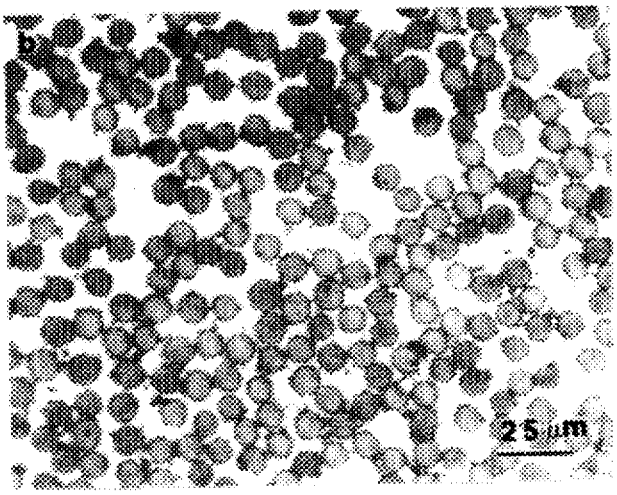
Figure 6 B
Figure 6

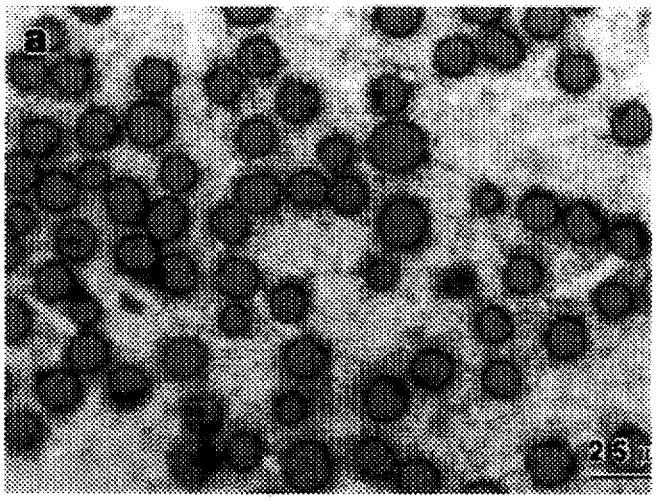
Figure 7 A
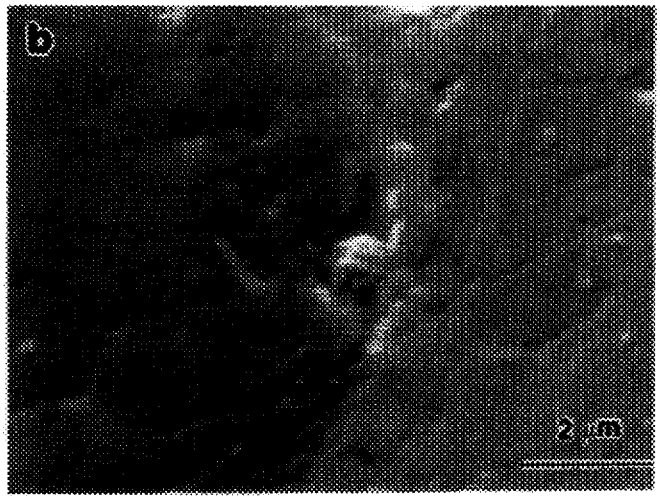
Figure 7 B
Figure 7

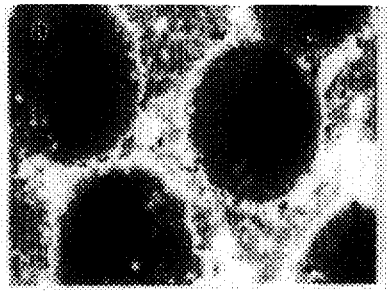
Figure 8 A
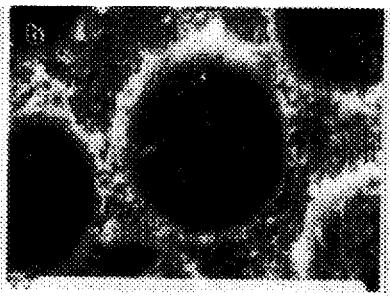
Figure 8 B
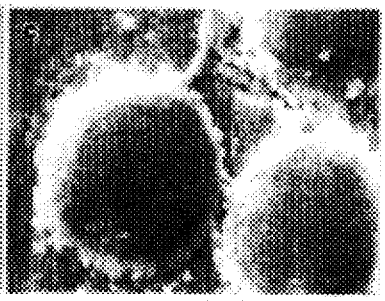
Figure 8 C
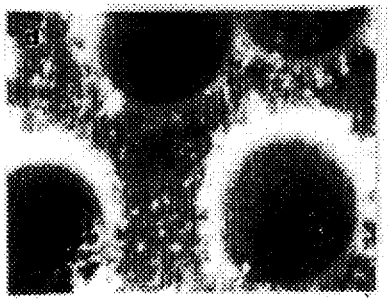
Figure 8 D
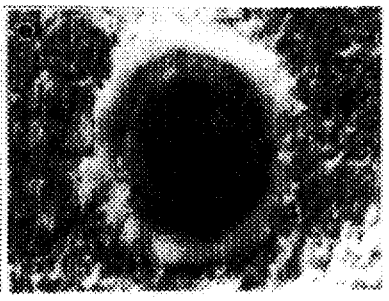
Figure 8 E
Figure 8

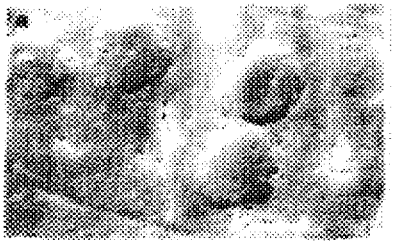
Figure 9 A
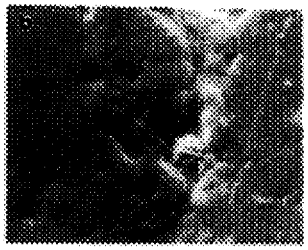
Figure 9 B
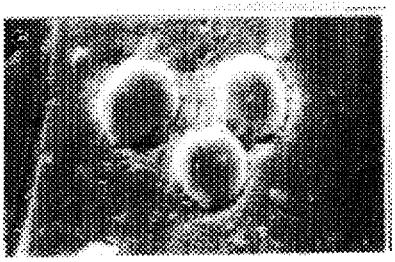
Figure 9 C
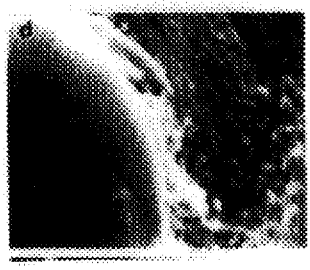
Figure 9 D
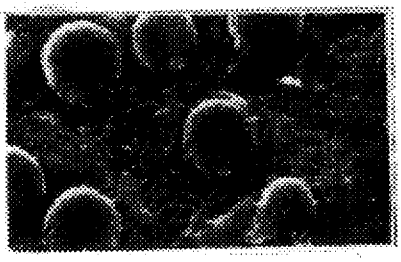
Figure 9 E
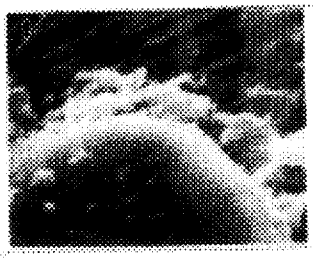
Figure 9 F
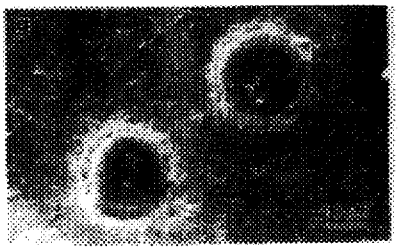
Figure 9 G
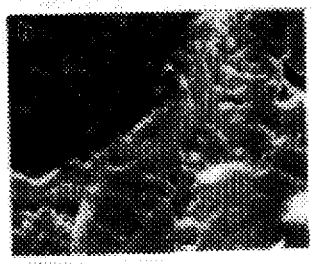
Figure 9 H
Figure 9

INFRARED PRESSURELESS INFILTRATION OF COMPOSITES

This is a continuation of application Ser. No. 08/125,570, filed Sep. 23, 1993, now abandoned.

The present invention provides a method for infrared pressureless infiltration of composites More specifically this invention provides a method for the infiltration of carbon fibers and silicon carbide fibers with aluminum and titanium matrices. Composites produced by the methods of the present invention are also included within the scope of this invention.

BACKGROUND OF THE INVENTION

Aluminum matrices with carbon fiber reinforcements and titanium matrix with silicon carbide fiber reinforcements are excellent candidates for structural use in the aerospace industry.

Carbon reinforced aluminum matrix composites are commonly fabricated by vacuum hot pressing, pressure infiltration processes or vacuum squeeze casting. Both these processes are expensive and place limitations on the size and shape of the composite produced.

Silicon carbide reinforced titanium matrix composites are commonly fabricated by diffusion bonding techniques which again are very expensive. Additionally, the diffusion bonding technology does not readily allow the fabrication of complicated shapes and high fiber volume fractions of composites. The method of the present invention, i.e., rapid infrared pressureless infiltration, can produce low cost, near net shaped composites. There is seen a total lack of relevant prior art in the application of infrared processing to the formation of composites. One of the reasons for the lack of prior art in this area, is due to the severity in the interfacial reactions between titanium and aluminum and possible ceramic reinforcements.

U.S. Pat. No. 3,553,820 discloses a method for producing aluminum carbon fiber composites by a process including coating carbon fibers with a thin but continuous film of tantalum, compacting the coated fibers into the desired form, infiltrating the voids between the compacted fibers with molten aluminum and cooling the resultant aluminum infiltrated tantalum coated carbon fibers to produce a composite article. Only after all this processing, can the article can be formed into a desired shape.

U.S. Pat. No. 3,871,834 discloses a carbon fiber reinforced aluminum composite material comprising an aluminum matrix containing an alloying element reactive with carbon to form a carbide and carbon fibers having a tensile strength greater than that of the aluminum matrix. In order to obtain the carbon fiber reinforced aluminum composite of this patent, it is desirable that aluminum is initially alloyed with the carbide forming element. When oriented carbon fibers are immersed into the molten alloy, the reaction of the added element in carbon fibers immediately takes place to form carbide and to reinforce the composite material. By laminating a plurality of units, such as plates of aluminum having carbon fibers and additive elements together arranged thereon and sealing ends of the lamination to prevent the oxidation of carbon fibers by atmosphere, and then heating, a reaction between the carbon fibers and the additive element can be effected.

U.S. Pat. No. 4,450,207 discloses a fiber reinforced metal type composite material comprised essentially of a mass of reinforcing fibers intimately compounded with matrix metal. The reinforcing fibers are either alumina fibers, carbon fibers or a mixture thereof. The matrix metal is an alloy consisting essentially of between about 0.5% and about 4.5% magnesium, less than about 0.2% each of copper and titanium, less than about 0.5% each of silicon, zinc and manganese and the remainder aluminum. Preferably, the amount of magnesium is between about 0.7% and about 4.5% and even more preferably it is between about 1% and about 4%. Various methods of manufacture of this fiber reinforced composite material are disclosed such as high pressure casting method, chemical vapor deposition method, physical evaporation deposition method and impregnation by applying vacuum and dipping the fibers simultaneously into the molten alloy. Other methods such as powder metallurgy methods are also generally disclosed. The patent characterizes the high pressure casting method as the most preferable method for the particular composition of this patent.

U.S. Pat. No. 4,614,690 relates to an organic fiber reinforced metal matrix composite having excellent mechanical properties and comprising a matrix of a metal or its alloy and inorganic fibers composing mainly of silicon, titanium or zirconium, carbon and oxygen as a reinforcing material. Several methods of producing the composite material of this invention are disclosed including diffusion bonding, melting-penetration, flame-spraying, electroposition, extrusion and hot rolling, chemical vapor deposition and a sintering method. All of these methods are disclosed in detail in this patent application. In the melting-penetration method, the composite material may be produced by filling the interstices of the fibers with a molten mass of aluminum, an aluminum alloy, magnesium, magnesium alloy, titanium, titanium alloy. Since wetting between the fibers and the matrix metal is good, the interstices of the arranged fibers can be uniformly filled with the matrix metal.

U.S. Pat. No. 4,732,779 discloses a process for the preparation of a fiber reinforced metal, including the steps of dipping continuous filament fibers or a bundle of continuous filament fibers in a solvent in which are suspended short fibers and whiskers of powders of a heat resistant substance selected from ceramics, carbon, metals and/or metallic compounds, thereby causing the short fibers and whiskers of powder to stick to the surface of the individual continuous filament fibers.

U.S. Pat. No. 4,929,513 discloses a process for the manufacture of a preformed wire for a carbon fiber reinforced aluminum composite material, including the steps of preparing a continuous fiber bundle of carbon filaments having a specific spectroscopy, coating each of the filaments with one or two materials and infiltrating the continuous fiber bundle with a matrix of aluminum or aluminum alloy. The infiltration of this patent is achieved by conventional methods as stated at column 6, lines 33 to 39, such as diffusion bonding, hot pressing, rolling, drawing, hot isostatic pressing and liquid phase methods such as casting.

U.S. Pat. No. 4,978,585 discloses a method for the formation of the improved reinforced matrix by plasma-spray forming a powder of the alloy to impart to the alloy particles a superheat during the plasma-spraying as the particles traverse the plasma plume. As a result of the super heat, the alloy is changed in its composition to reduce the aluminum concentration and to increase the niobium and the titanium concentration on a relative basis. As a result of the change in composition the crystal form of the spray deposited matrix is altered to increase the amount of the beta-phase crystal form of alloy which is present and to decrease the amount of the alpha-2 crystal form of alloy which is present. The result is the formation of a matrix which is less subject to cracking and which has greater strength.

U.S. Pat. No. 5,017,438 discloses a method for forming a composite having a matrix which is stronger and resistant to cracking, the composite being reinforced by silicon carbide fibers. Silicon carbide fibers are first RF plasma-spray coated with a niobium metal and the matrix metal of titanium base alpha-2 crystal structure is next RF plasma-spray deposited over the niobium coated SiC fibers to form a layer of titanium based metal reinforced by SiC fibers. A plurality of layered structures are then consolidated by heat and pressure into a composite structure. U.S. Pat. No. 5,045,407 is related to above disclosed U.S. Pat. No. 5,017,438, in that same material is obtained except that the U.S. Pat. No. 5,045,407 discloses the composition and the product, whereas earlier disclosed U.S. Pat. No. 5,017,438 discloses and claims the methods of formation of the product.

The present invention provides a method for the infiltration of fibers by matrix materials, by heating the fibers and the matrix materials very rapidly, at rates up to 200° C. per second, to the melting point of the matrix, by infrared heating, contacting the molten matrix and the fibers for a period of time sufficient for infiltration to occur, but less than the time that would be required for significant interfacial reactions to occur.

BRIEF DESCRIPTION OF THE DRAWINGS

FIG. 1 shows a cross-sectional micrograph of 40 volume percent P-55 carbon fiber reinforced Ti 85 alloy, fabricated by the process of the present invention at 1350° C. for 10 seconds.

FIG. 2 shows a cross-sectional micrograph of 23 volume percent SCS-6 SiC fiber reinforced Ti 80 alloy, fabricated by the process of the present invention at 1300° C. for 10 seconds.

FIG. 3 Shows a cross-sectional micrograph of a carbon fiber reinforced Ti 80 alloy fabricated by the process of the present invention at 1300° C. for 1, 5, 60 and 120 seconds.

FIG. 4 shows a cross-sectional micrograph of a 30 volume percent carbon fiber reinforced Ti 80 alloy fabricated by the process of the present invention for 10 seconds.

FIG. 5 shows a prior art cross-sectional micrograph of: (a) carbon fiber reinforced Ti-25 weight percent Cu alloy, fabricated by liquid infiltration using induction hating; (b) SCS-6 Sic fiber reinforced Ti-2411 matrices fabricated by solid state diffusion bonding.

FIG. 6 shows cross-sectional micrograph of 30 volume percent carbon fiber reinforced 6061 aluminum alloy fabricated by the process of the present invention at 1100° C. for 5 seconds.

FIG. 7 shows a cross-sectional micrograph of 30 volume percent Nicolon SiC fiber reinforced 6061 alloy fabricated by the process of the present invention at 1100° C. for 5 seconds.

FIG. 8 shows cross-sectional micrographs of aluminum alloy fabricated by the process of the present invention for: (a) 5 seconds, (b) 15 seconds, (c) 17 seconds, (d) 23 seconds and (e) 30 seconds.

FIG. 9 shows cross-sectional micrographs of 5 volume percent SiC fiber reinforced 6061 aluminum alloy fabricated by the process of the present invention at 1100° C. for: (a,b) 5 seconds, (c,d) 17 seconds, (e,f) 23 seconds and (g,h) 30 seconds.

SUMMARY OF THE INVENTION

In accordance with the invention there has been provided a method for the infiltration of fibers by a matrix material for purposes of reinforcement, comprising the steps of: heating the fibers and the matrix by infrared heating in an inert atmosphere at a rate of up to 200° C./sec, to a temperature above the melting point of said matrix material; and contacting the molten material with said fibers for a period sufficient for infiltration to occur, but less than the time that would be required for significant oxidation and interfacial reactions to occur.

DETAILED DESCRIPTION OF THE INVENTION

The invention will now be described as embodied in methods for infrared pressureless infiltration of composite materials.

The infrared infiltration process consists of heating the fibers along with the matrix material in an infrared furnace to temperatures above the melting point of the matrix. The fibers are stacked either in an orderly manner or as randomly oriented fibers in a high purity graphite crucible. The graphite crucible was heated to remove any moisture just prior to the introduction of the fibers. Restraints by way of graphite screws, which run perpendicular to the fiber direction, are used at the two ends of the fibers to prevent the fibers from floating up. The matrix material to be infiltrated is cut to a size to fit the crucible and kept above the fibers on graphite screws such that the matrix was not in physical contact with the fibers during heating up. The lay-up was heated at rates of 100°–200° C. per second to temperatures above the melting point of the alloy.

Due to the fast heating capabilities, oxidation is limited and hence wetting and flow characteristics of the alloy are improved. Moreover, due to fast heating, a superheat is established in the matrix material and hence melting occurs at a temperature above the actual melting point of the alloy which again enhances wetting and flow characteristics. Due to short processing times, interfacial reaction is limited. High quality composites without any voids and with only small, well controlled interfacial reactions can be produced at a significantly lower cost. The strength and modulus of 40 volume percent carbon fiber reinforced titanium alloy matrix composites produced are in the order of 1100 MPa and 200 GPa respectively and that of 23 volume % SiC (SCS-6) fiber reinforced titanium alloy matrix composites are 1735 MPa and 195 GPa respectively. The strength of carbon fiber reinforced titanium alloy matrix composites are about 600% higher than that reported by Toloui (Proceedings of the Fifth International Conference on Composites, 1985, page 773) and comparable to that for currently available SiC fiber reinforced titanium alloy matrix composites.

REINFORCED TITANIUM MATRICES

Example 1

40 volume percent P-55 carbon fibers were stacked in a graphite crucible along with an in-house titanium alloy Ti 85, and heated in an infrared furnace at a heating rate 200° C./s. The liquid alloy was held in contact with the fibers for 10 seconds and then cooled rapidly, at a rate of 100° C./s to about 900° C., then further cooled at a slower rate to room temperature. The total processing time was in the order of 2 minutes. The strength and modulus of the composites produced were 1100 MPa and 200 GPa respectively. FIG. 1 shows the cross section of these composites.

Example 2

23 volume percent SiC fibers (SCS-6 from Textron Specialty Materials) were arranged in a graphite crucible along with an in house titanium alloy Ti 80, and introduced into an infrared furnace. Heating was done at a rate of 200° C./s to 1300° C. The liquid alloy and the fibers were held in contact for 10 seconds and then cooled as mentioned earlier. The strength and modulus of the composites produced were 1734 MPa and 195 GPa, respectively. FIG. 2 shows the cross section of these composites.

Example 3

5 volume percent P-55 carbon fibers were stacked in a graphite crucible along with a titanium alloy, Ti 80 and heated in an infrared furnace at a rate of 200° C./s to a temperature of 1300° C. for 1, 5, 25, 60 and 120 seconds. The composites were cooled as stated earlier. FIG. 3 shows the cross section of these composites.

Example 4

30 volume percent carbon fibers were stacked in a graphite crucible along with a titanium alloy, Ti 80 and heated in an infrared furnace at a rate of 200° C./s to a temperature of 1300° C. for 10 seconds. The composites were cooled as stated earlier. FIG. 4 shows the cross section of these composites.

Toloui produced carbon fiber reinforced Ti-25 wt % Cu alloys by liquid infiltration using induction heating. FIG. 5 (*a*) shows the cross section of composites fabricated by Toloui. Fibers are extensively reacted in the composites fabricated by Toloui. The average size of the reaction zone of 5 μm in Toloui's composites compared that of about 1 μm in composites processed by the infrared technique. The strength of composites produced by Toloui is 184 MPa whereas that by ours is 1100 MPa. FIG. 5 (*b*) shows SCS-6/Ti-2411 composites produced by Brindley et al. (P. K. Brindley et al., NASA TM 100956, 1988) using solid state diffusion bonding. They observed a reaction zone of about 2 μm thick compared to small dissolution of the coating in our process. The strength and modulus of the infrared processed composites were either comparable to or in several instances superior to the ones produced by solid state processes.

REINFORCED ALUMINUM MATRICES

Example 1

30 volume percent P-55 carbon fibers were stacked in a graphite crucible along with a commercial aluminum alloy, 6061 (Alcoa), and heated in an infrared furnace at a heating rate 200° C./s to a temperature of 1100° C. The liquid alloy was held in contact with the fibers for 5 seconds and then cooled to room temperature. The total processing time was in the order of 2 minutes. FIG. 6 shows the cross section of these composites.

Example 2

30 volume % Nicalon SiC (Dow Corning) fibers were stacked in a graphite crucible along with 6061 aluminum alloy and heated in an infrared furnace at a heating rate of 200° C./s to a temperature of 1100° C., held for 5 seconds and then cooled. FIG. 7 shows the cross section-of these composites.

Example 3

5 volume % carbon fibers P-55 (Union Carbide) were stacked in a graphite crucible along with 6061 aluminum alloy and heated in an infrared furnace at a rate of 200° C./s to a temperature of 1100° C. for 5, 17, 23 and 30 seconds. FIG. 8 shows the cross section of these composites.

Example 4

5 volume % Nicalon SiC fibers were stacked in a graphite crucible along with 6061 aluminum alloy and heated in an infrared furnace at a rate of 200° C./s to a temperature of 1100° C. for 5, 17, 23 and 30 seconds. FIG. 9 shows the cross section of these composites.

Squeeze casting can also produce reinforced aluminum matrices with insignificant interfacial reactions. However, the requirement of pressurizing the vacuum equipment make such composites expensive. On the other hand, the infrared process can produce reinforced aluminum composites without the application of external pressure or vacuum in a very short time at a much lower cost.

Thus it is apparent that there have been provided, in accordance with the invention, a method for the infrared pressureless infiltration of composite materials, including infiltration of carbon fibers and silicon carbide fibers with aluminum matrices and infiltration of silicon carbide and carbon fibers with titanium alloy matrices, which fully satisfy the aspect and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations which fall within the spirit and broad scope of the appended claims.

We claim:

1. A method for the infiltration of fibers by a metal matrix material for purposes of reinforcement, comprising the steps of:

heating the fibers and the metal matrix material by infrared heating at a rate greater than about 100° C. per second to a temperature above the melting point of said metal matrix; and contacting the molten metal matrix with said fibers for a period of time sufficient to cause said molten metal to infiltrate said fibers, but less than the time that would be required for significant interfacial reactions to occur.

2. The method of claim 1 wherein said contacting is conducted in an inert atmoshphere.

3. The method of claim 1, wherein said matrix is selected from the group consisting of an aluminum matrix, titanium matrix, magnesium matrix and said fiber is selected from the group consisting of carbon fibers, silicon carbide fibers and alumina fibers.

4. The method of claim 1, wherein said time of contacting ranges from 5–60 seconds.

5. The method of claim 1, wherein said step of contacting the molten metal matrix with the fibers is terminated by cooling said metal matrix to a temperature below its melting point.

6. The method of claim 1, wherein said heating rate is between about 100° and about 200° C. per second.

7. The method of claim 6, wherein said heating rate is about 200° C. per second.

8. A method of producing a fiber reinforced metal matrix composite, comprising the steps of:

(a) rapidly heating a metal matrix material by infrared heating at a rate greater than about 100° C. per second to a temperature above the melting point of said metal matrix;

(b) contacting the molten metal matrix with reinforcing fibers;

(c) maintaining said metal matrix in a molten state for a period of time sufficient to cause said molten metal to infiltrate said fibers, but less than the time that would be required for significant interfacial reactions to occur.

9. The method of claim 8, wherein said fibers are chosen from the group consisting of: carbon fibers, silicon carbide fibers and alumina fibers.

10. The method of claim 9, wherein said metal matrix material is chosen from the group consisting of: aluminum, titanium and magnesium.

11. The method of claim 10, wherein said heating rate is between about 100° and about 200° C. per second.

12. The method of claim 11, wherein said heating rate is about 200° C. per second.

13. The method of claim 10, further comprising the step of cooling said metal matrix and fibers to a temperature below the melting point of said metal.

* * * * *

UNITED STATES PATENT AND TRADEMARK OFFICE

CERTIFICATE OF CORRECTION

PATENT NO. : 5,697,421

DATED : December 16, 1997

INVENTOR(S) : Ray Y. Lin
Sunil G. Warrier

It is certified that error appears in the above-indentified patent and that said Letters Patent is hereby corrected as shown below:

Line 4, Column 1 insert the following statement:

--The research underlying this invention has been supported by the following grant: NASA NAGW-1407--

Signed and Sealed this

Fifth Day of May, 1998

Bruce Lehman

*Attest:*

BRUCE LEHMAN

*Attesting Officer*

*Commissioner of Patents and Trademarks*